United States Patent [19]

Shirley

[11] Patent Number: 5,038,872

[45] Date of Patent: Aug. 13, 1991

[54] DRILL STEERING APPARATUS

[76] Inventor: Kirk R. Shirley, 13376 Trail Hollow, Houston, Tex. 77079

[21] Appl. No.: 536,328

[22] Filed: Jun. 11, 1990

[51] Int. Cl.[5] ..... E21B 7/08; E21B 17/10

[52] U.S. Cl. ..... 175/76; 175/325

[58] Field of Search ..... 175/45, 73, 76, 325

[56] References Cited

U.S. PATENT DOCUMENTS

| | | | |
|---|---|---|---|
| 3,593,810 | 7/1971 | Fields | 175/76 |
| 3,916,998 | 11/1975 | Bass, Jr. et al. | 166/301 |
| 4,071,101 | 1/1978 | Ford | 175/325 |
| 4,101,179 | 7/1978 | Barron | 308/4 A |
| 4,220,213 | 9/1980 | Hamilton | 175/45 |
| 4,394,881 | 7/1983 | Shirley | 175/76 |
| 4,635,736 | 1/1987 | Shirley | 175/325 |
| 4,690,229 | 9/1987 | Raney | 175/325 |

*Primary Examiner*—Terry L. Melius

[57] ABSTRACT

An improved drill steering apparatus which includes a lower stabilizer assembly mounted on the drill string in close relationship to the drill bit and an upper stabilizer assembly mounted on said drill string at a position spaced above said lower stabilizer assembly. In the preferred form of the invention, the pressure responsive element of the stabilizer assemblies are pressure responsive bladders and the lower or slave bladders have a larger effective pressure area than the upper bladders. In a modified form of the invention, the pressure responsive elements are pistons and the lower stabilizer assembly includes at least one more piston in each ground than the upper stabilizer assembly.

8 Claims, 5 Drawing Sheets

DRILL STEERING APPARATUS

BACKGROUND

The present invention relates to the field of a steering apparatus to be used in a drill string during the drilling of a well to control the direction in which the drill penetrates the earth. This invention is an improvement on my prior inventions as shown in U.S. Pat. Nos. 4,394,881 and 4,635,736. In both of these prior inventions an upper sensing assembly and a lower force applying assembly were provided above the drill bit with the upper assembly including a means for sensing the low side of the hole and the lower assembly including means for exerting a transverse thrust to the upper end of the drill bit to control its direction. This allows a relatively straight or vertical well bore to be drilled or to control the slope and direction of any intentional deviation from the vertical.

In both upper and lower assemblies, pistons have been used both as the sensing means and the slave force applying means. In use these pistons, which are subject to substantial vibration during drilling because of the impacts of the drill bit with the formation, have been found to have damaged seals and to leak before the string has to be pulled to replace a worn drill bit. The pulling of the string to replace piston seals in the steering device is expensive and is desired to be avoided.

The present invention also provides for an increase of the forces exerted by the lower assembly against the well bore to be more than the forces exerted between the upper assembly and the well bore.

U.S. Pat. Nos. 3,916,998; 4,071,101; 4,101,179 and 4,220,213 all disclose drilling stabilizers and were clearly distinguished by the present inventor in his most recently issued U.S. Pat. No. 4,635,736.

SUMMARY

The present invention relates to an improved steering tool and provides a structure for securing to a drill string above the drill bit which includes an upper stabilizer including sensing means and a lower stabilizer including transverse force applying means. In the preferred form of the present invention both the sensing and the force applying means are pressure responsive means and the force applying means has a greater area so that its developed force is greater than the force of the upper pressure responsive sensing means. Additionally, the pressure responsive means include a resilient bladder structure which avoids leakage caused by the drill bit vibrations. With the bladder structure, each bladder of the lower assembly has a larger effective pressure area than the bladder of the upper assembly.

An object of the present invention is to provide an improved drill steering tool which is not subject to leakage caused by vibrations of the drill bit in the well bore during drilling.

Another object of the present invention is to provide an improved drill steering apparatus which applies a greater force immediately above the drill bit than the force against the wall of the upper sensing assembly.

BRIEF DESCRIPTION OF THE DRAWINGS

These and other objects and advantages of the present invention are hereinafter set forth and explained with respect to the drawings wherein.

DESCRIPTION OF THE PREFERRED EMBODIMENTS

Both illustrated embodiments of the present invention are the same as the tool illustrated in my prior patents set forth above and operate in a similar manner except for the changed structure and relationships set forth below in detail. For this reason, reference is made to such prior patents for a more complete understanding of the operation and the relationships of similar components and the complete apparatus.

Figure 1:
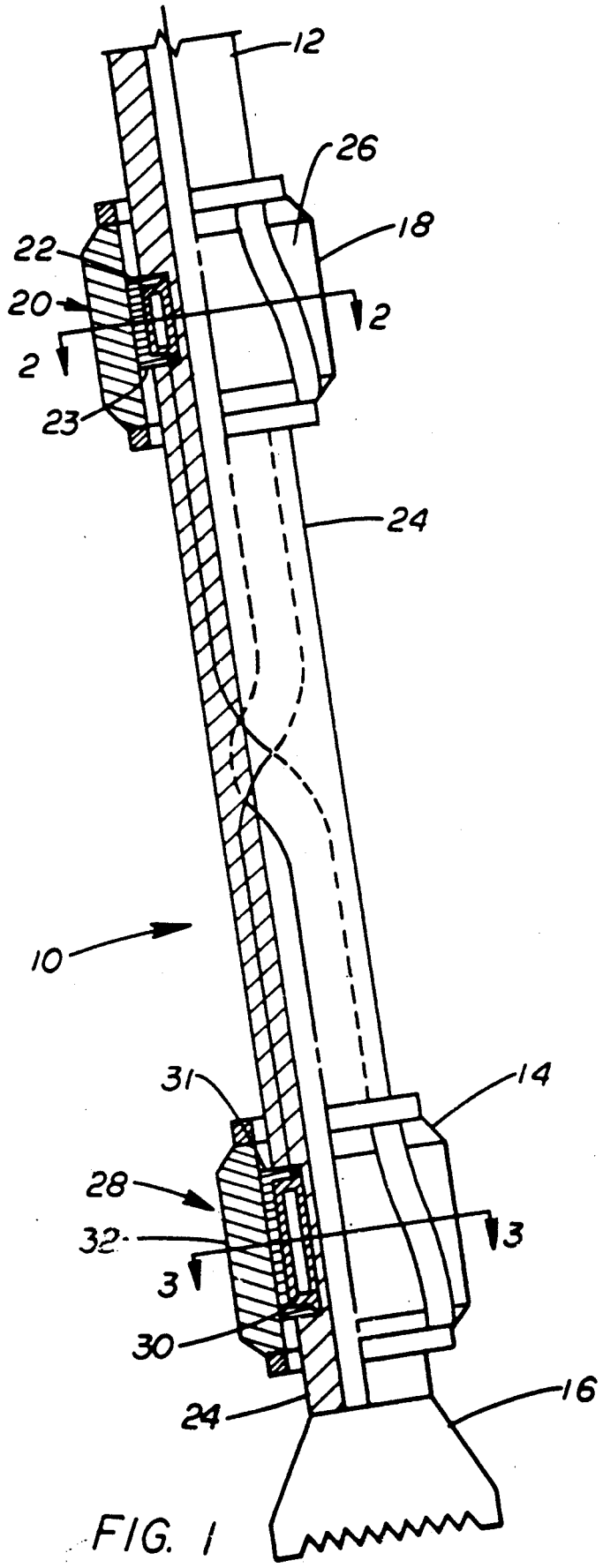
FIG. 1 is an elevation view of a well bore with a drill string therein and the preferred form of improved steering apparatus of the present invention positioned on the drill string immediately above the drill bit.
Figure 2:
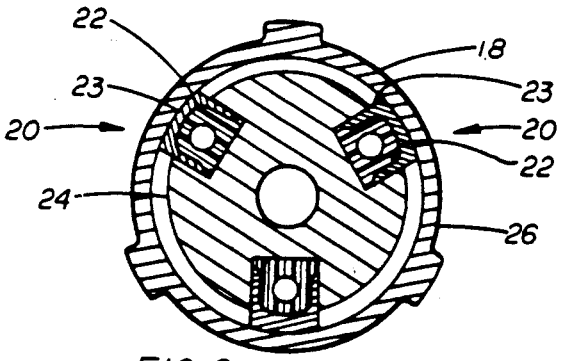
FIG. 2 is a transverse sectional view of the upper stabilizer assembly taken along line 2—2 in FIG. 1.
Figure 3:
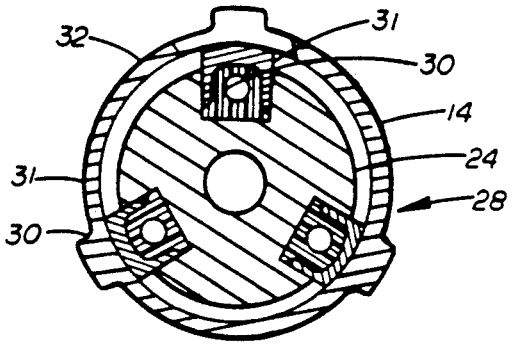
FIG. 3 is a transverse sectional view of the lower stabilizer assembly taken along line 3—3 in FIG. 1.

Steering apparatus 10 illustrated in FIG. 1 is the preferred steering apparatus of the present invention and is installed on drill string 12 with lower stabilizer 14 being mounted immediately above drill bit 16 and upper stabilizer 18 being mounted on drill string 12 in spaced relationship above lower stabilizer 14 as shown. In the operation of the improved apparatus, it is preferred that there be three sets of pressure responsive elements disposed annularly in both the upper stabilizer 18 and the lower stabilizer 14 as shown in FIGS. 2 and 3. With at least three sets of pressure responsive element as shown, a relatively uniform pressure is applied to the control of the drilling direction of the drill bit 16. With only two annular sets of pressure responsive elements, a pressure force is applied and then released so that during a portion of the rotation of the drill bit 16 there is no control force being exerted. However, in the present invention it is preferred that there be a larger pressure responsive area for the pressure responsive element in the lower stabilizer 14 than in the upper stabilizer 18. This is shown by a comparison of FIGS. 4 and 5.

Also, it should be noted that pressure responsive elements 20 in upper stabilizer 18, which form the sensing means or master elements for the apparatus 10, are resilient bladders 22 which are mounted in the exterior of drill string or mandrel 12 and have their outer surfaces within metal caps 23 which are in engagement within upper stabilizer ring 26. Pressure responsive elements 28 in lower stabilizer 14, which form the force exerting means or slave elements for apparatus 10, are resilient bladders 30 which are mounted in mandrel 24 and having their outer surfaces within metal caps 31 which are in engagement within lower stabilizer ring 32.

Figure 6:
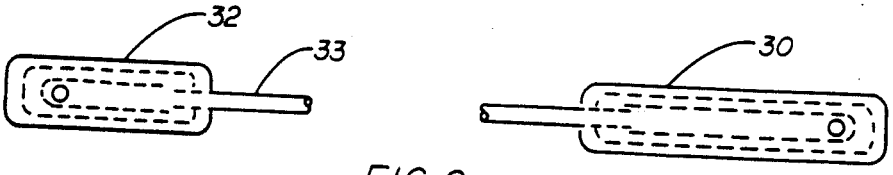
FIG. 6 is an elevation view of the bladders used with the apparatus illustrated in FIGS. 1 through 5.
Figure 4:
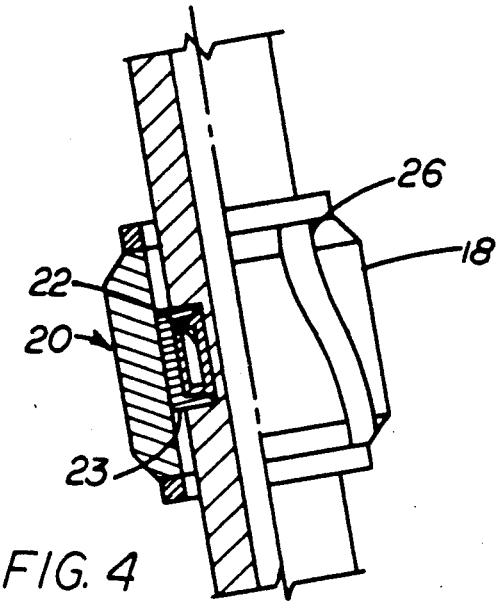
FIG. 4 is a longitudinal sectional view taken along line 4—4 in FIG. 2.
Figure 5:
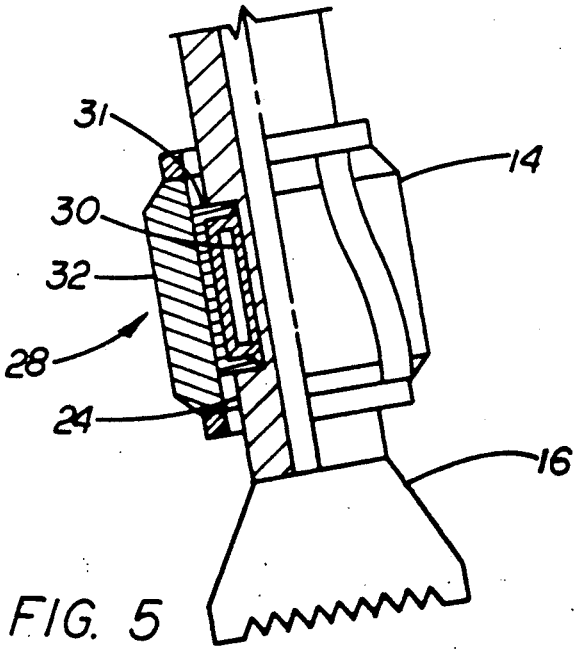
FIG. 5 is a longitudinal sectional view taken along line 5—5 in FIG. 3.
Figure 7:
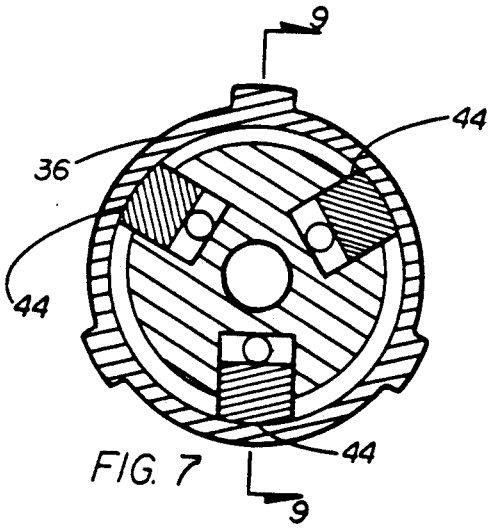
FIG. 7 is a transverse sectional view of the upper stabilizer assembly in a modified form of the present invention.
Figure 8:
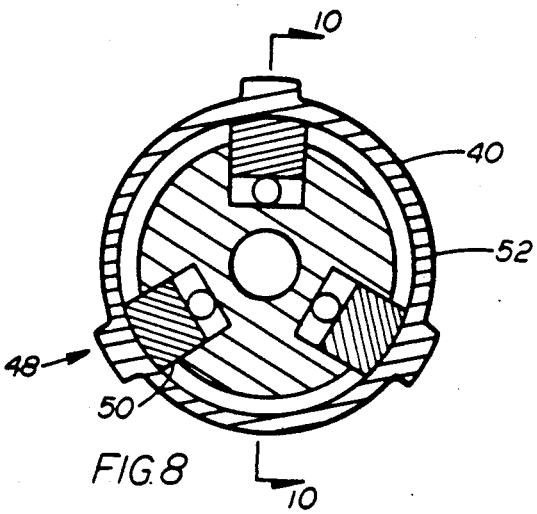
FIG. 8 is a transverse sectional view of the lower stabilizer assembly in the modified form of the present invention.
Figure 9:
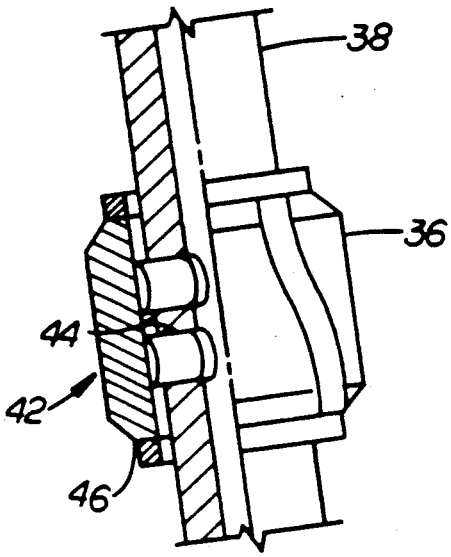
FIG. 9 is a longitudinal sectional view taken along line 9—9 in FIG. 7.
Figure 10:
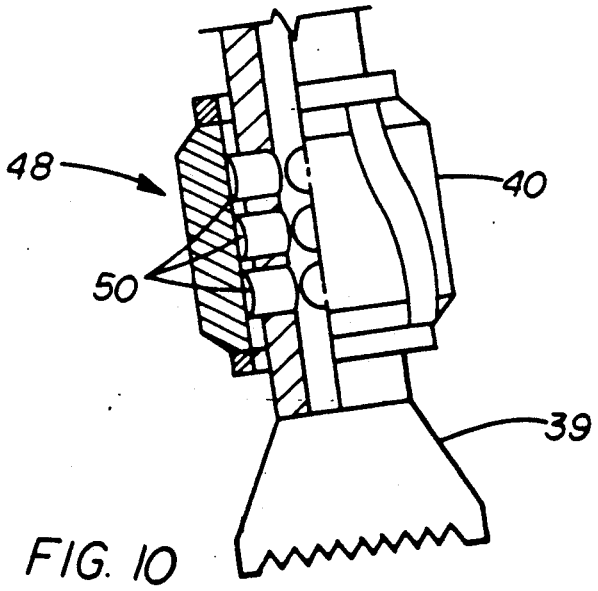
FIG. 10 is a longitudinal sectional view taken along line 10—10 in FIG. 8.

As can be seen in FIGS. 4, 5 and 6, bladders 22 have a smaller effective pressure area than bladders 30. Both bladders 22 and 30 include a suitable fluid line 33 by which they are connected and also have a means in bladders 30 for filling the coupled bladders with the fluid to be used and bladders 22 have a means for venting trapped gas during filling. The construction of bladders 22 and 30 are similar but bladders 30 have a length which is approximately one and one-half times the length of bladders 22. The fluid pressure is transmitted between upper stabilizer assembly and lower stabilizer assembly in the manner illustrated in my prior patents. Thus, the same fluid pressure is exerted on both the upper or master bladders 22 and the lower or slave bladders 30. With the larger area the lower or slave bladders 30 exert a force which is approximately one and one-half times the force exerted by bladders 22. The valving which controls the flow of fluid pressure between the upper and lower assemblies is the same as illustrated and described in my prior patents.

The improved apparatus 10 not only eliminates the problems associated with leaks encountered in prior devices which can shorten the effective life of the unit but also provides the lower slave assembly with greater effective pressure areas than the upper master assembly so that the slave or force applying pressure responsive units exert a greater force than the upper master units.

Modified form of apparatus 34, illustrated in FIGS. 7 through 10, includes upper stabilizer assembly 36 which is mounted on the drill string or mandrel 38 in the usual manner at a position spaced upwardly from lower stabilizer assembly 40, which is mounted on drill string 38 immediately above the drill bit 39. Upper stabilizer assembly 36 includes pressure responsive sensing means 42 which, as shown, are the pistons 44. As can be seen from FIGS. 7 and 9, pistons 44 are mounted in axially aligned pairs and spaced annularly around the circumference of the exterior of drill string 38 to provide three pairs of pistons 44 engaging the interior of upper stabilizer ring 46. Lower stabilizer assembly 40 includes pressure responsive force applying mean 48 which, as shown, are pistons 50. As can be seen from FIGS. 8 and 10, pistons 50 are mounted in axially aligned groups of threes and spaced annularly around the circumference of the exterior of drill string 38 to provide three groups of pistons engaging the interior of lower stabilizer ring 52. It is preferred that each of pistons 44 have the same effective pressure area as pistons 50, so that having one extra piston 50 in each group provides approximately one and one-half times the force available from the lower groups of pistons 50 as from the upper pairs of piston 44.

Thus, with the modified apparatus described above, the provision of the additional force to be applied by the slave pistons 50 as compared to the force from the master pistons 44 is provided. This provides a quicker steering response by the apparatus 34 than by those structures of the prior art.

What is claimed is:

1. A drill steering tool for mounting on a drill string above the drill bit comprising a lower slave stabilizer assembly mounted on the drill string close to the drill bit, an upper master stabilizer assembly mounted on the drill string in a position spaced above the lower slave stabilizer assembly, said upper master stabilizer assembly having an upper stabilizer ring, and a plurality of pressure responsive sensing elements mounted annularly around the exterior of said string and engaging the interior of said upper stabilizer ring, said lower slave assembly having a lower stabilizer ring, and a plurality of pressure responsive force applying elements mounted annularly around the exterior of said string and engaging the interior of said lower stabilizing ring and being respectively interconnected with said upper pressure responsive sensing elements, said pressure responsive force applying elements of said lower slave assembly having a greater effective pressure area than said respective pressure responsive sensing elements of said upper master stabilizer assembly, thereby exerting a greater force close to the drill bit.

2. A drill steering apparatus according to claim 1 wherein said sensing elements of said upper stabilizer assembly include pairs of sensing pistons, and said pressure responsive force applying elements of said lower stabilizer assembly include groups of more than two force applying pistons, said pairs of sensing pistons each being connected to one of said groups of force applying pistons.

3. A drill steering apparatus according to claim 1 wherein said sensing elements are pressure responsive bladders, and said force applying elements are pressure responsive bladders with a greater area than the sensing element to which they connect to provide a larger force exerted near the drill bit.

4. A drill steering apparatus according to claim 3 wherein said force applying element have an effective pressure area which is approximately one and one-half times the effective pressure area of said sensing elements.

5. A drill steering apparatus according to claim 2 wherein said upper stabilizer assembly includes pairs of pistons arranged annularly about said drill string, and said lower stabilizer assembly includes groups of three pistons arranged annularly about said drill string.

6. A drill steering apparatus suitable for connecting into a drill string close to the drill bit comprising a mandrel suitable for connecting into a drill string close to a drill bit at the lower end of the drill string, a lower slave stabilizer assembly mounted on the mandrel near its lower end, an upper master stabilizer assembly mounted on the mandrel in a position spaced above the lower slave stabilizer assembly, said upper master stabilizer assembly having an upper stabilizer ring, and a plurality of pressure responsive sensing elements mounted annularly around the exterior of said mandrel and engaging the interior of said upper stabilizer ring, said lower slave assembly having a lower stabilizer ring, and a plurality of pressure responsive force applying elements mounted annularly around the exterior of said mandrel and engaging the interior of said lower stabilizing ring and being respectively interconnected with said upper pressure responsive sensing elements, said pressure force applying elements of said lower slave assembly having a greater effective pressure area than said respective pressure responsive sensing elements of said upper master stabilizer assembly, thereby exerting a greater force close to the drill bit.

7. A drill steering apparatus according to claim 6 wherein said upper stabilizer assembly includes pairs of sensing pistons, and said lower stabilizer assembly includes groups of more than two force applying pistons, said pairs of sensing pistons each being connected to one of said groups of force applying pistons.

8. A drill steering apparatus according to claim 6 wherein said sensing elements are pressure responsive bladders, and said force applying elements are pressure responsive bladders with a greater area than the sensing element to which they connect to provide a larger force exerted near the drill bit.

* * * * *